US005347761A

United States Patent [19]

Murai

[11] Patent Number: 5,347,761

[45] Date of Patent: Sep. 20, 1994

[54] METHOD FOR DETERMINING THE DEFORMATION OF WORKPIECE ON GRINDING MACHINE

[75] Inventor: Yasuhiko Murai, Kyoto, Japan

[73] Assignee: Mitsubishi Jukogyo Kabushiki Kaisha, Tokyo, Japan

[21] Appl. No.: 945,142

[22] Filed: Sep. 15, 1992

[30] Foreign Application Priority Data

Sep. 18, 1991 [JP] Japan ..... 3-238374

[51] Int. Cl.[5] ..... B24B 5/00

[52] U.S. Cl. ..... 451/364; 451/331

[58] Field of Search ..... 51/165.71, 165.72, 165.75, 51/165.77, 324

[56] References Cited

U.S. PATENT DOCUMENTS

| | | | |
|---|---|---|---|
| 3,811,228 | 5/1974 | Nagashima et al. | 51/165.71 |
| 3,898,440 | 8/1975 | Fukuma et al. | 51/165.71 |
| 4,018,010 | 4/1977 | Pozzetti et al. | 51/165.71 |
| 4,150,513 | 4/1979 | Smith et al. | 51/165.71 |
| 4,179,854 | 12/1979 | Munekata et al. | 51/165.71 |
| 4,934,105 | 6/1990 | Sigg | 51/165.77 |
| 5,025,593 | 6/1991 | Kawaguchi et al. | 51/165.77 |
| 5,103,596 | 4/1992 | Fujii et al. | 51/165.77 |

FOREIGN PATENT DOCUMENTS

| | | | |
|---|---|---|---|
| 114876 | 5/1988 | Japan | 51/165.77 |
| 1291379 | 2/1987 | U.S.S.R. | 51/165.77 |

*Primary Examiner*—Jack W. Lavinder
*Attorney, Agent, or Firm*—McAulay Fisher Nissen Goldberg & Kiel

[57] ABSTRACT

A method for determining the deformation of workpiece on a grinding machine is proposed, in which the deformation of workpiece can be determined without using the less reliable initial deformation.

Suppose the deflection at the beginning and the final deflection for the last time be T′ (s) and T′ (e), respectively, and the deformation preset for the grinding completion time be Ta, the deformation T (s) at the operation start time for the workpiece in the present time is approximated by the expression $$T(s)=T'(s)-T'(e)+Ta$$

Suppose the shift of grinding wheel for the workpiece be ΔA, and the change in diameter be D(x)−D(s), the deformation T(x) at a time for the present time is determined from the expression $$T(x)-\Delta A+(D(x)-D(s))/2+T(s).$$

8 Claims, 3 Drawing Sheets

METHOD FOR DETERMINING THE DEFORMATION OF WORKPIECE ON GRINDING MACHINE

1. FIELD OF THE INVENTION

Figure 1:
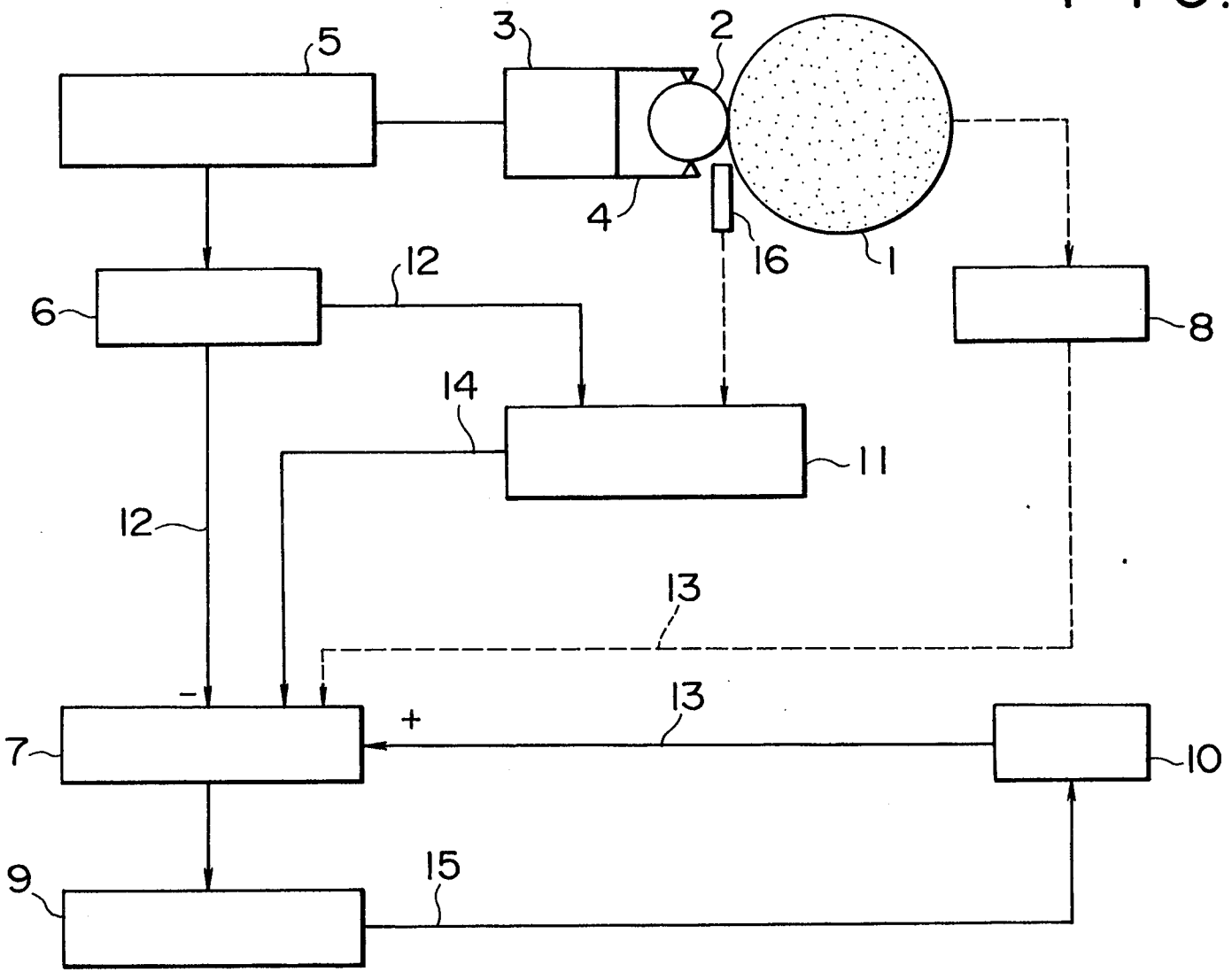

The present invention relates to a method for determining the deformation of a workpiece while it is being ground on a grinding machine.

A workpiece deforms while being ground. Obtaining data as to the deformation is necessary for controlling the grinding machine.

For example, on an external cylindrical grinding machine, an optimal control technology has been proposed. In a optimizing control, depending on the conditions of the workpiece and/or the conditions of the grinding wheel, the infeed velocity of the grinding wheel or the change point of infeed velocity is changed, so as to grind various kinds of workpieces. In an optimal control, the deformation of the workpiece is calculated to control the infeed velocity so the deformation becomes a predetermined value.

2. RELATED ART STATEMENT

According to the conventional technology, the deformation of a workpiece is determined usually on the basis of the position of the grinding wheel at the finished state of workpiece. Specifically, the deformation is detected as a deviation of the actual position of the grinding wheel compared to the normal position of the grinding wheel. However, when the deformation is detected on the basis of the position of the grinding wheel at the end of the grinding, no correct deformation can be determined, for example, when the grinding wheel is worn by grinding.

To determine the exact deformation, it is necessary to calculate on the basis of the initial, position prior to deformation namely, the position when the grinding wheel begins to contact the workpiece. It is, however, difficult to detect exactly this position.

If the contact of the grinding wheel with the workpiece is detected by means of a shock sensor, the detected position will depend on the sensitivity of the shock sensor. In addition, if the roundness of workpiece is poor, the detected position of contact will be indefinite even for the same workpiece.

When the deformation is calculated on the basis of a position where the workpiece is ground to some extent, in place of the position of the beginning of the contact, the amount of deformation already occurred is not considered, hence the correct deformation cannot be obtained.

Thus, in the prior art, it is difficult to determine the deformation of a workpiece exactly; therefore, optimization control using deformation is hardly used practically in a grinding machine.

3. OBJECT AND SUMMARY OF THE INVENTION

An object of the present invention is to provide a method to determine the deformation of a workpiece so as to use it in the control of a grinding machine.

The object of the present invention is achieved by a method to determine the deformation of a workpiece on a grinding machine according to the present invention. In this method, a grinding machine comprises a workpiece dimension detecting means for automatically detecting the dimension of a workpiece during the grinding, a shift detecting means for determining the shift of a grinding wheel by measurement or calculation, a calculation start point setting means for setting the start point of calculation according to the detection or calculation of the beginning of the contact between the grinding wheel and the workpiece, a deformation determining means for calculating a deformation of the workpiece on the basis of the dimension of the workpiece and the shift of the grinding wheel, and a control means for controlling the grinding machine. The deformation of the workpiece is determined from the dimension of the workpiece and the shift of the grinding wheel, and the deformation finally obtained is used as the initial deformation in the calculation of deformation for the next workpiece.

In the grinding of workpieces of the same material, the deformation finally obtained in the calculation for one workpiece is used as the initial deformation for the next workpiece, by which the deformation of a workpiece can be calculated even when the start position is set arbitrarily, irrespective of the calculation start position of deformation. Therefore, it is possible to avoid any portion of a workpiece where the roundness is too poor and the accuracy is too low to detect the beginning of contact between the grinding wheel and the workpiece, and the calculation can be started after the grinding has begun to some extent. The deformation is reliable and it can be used in optimizing control of a grinding machine.

4. BRIEF DESCRIPTION OF THE DRAWINGS

Figure 2:
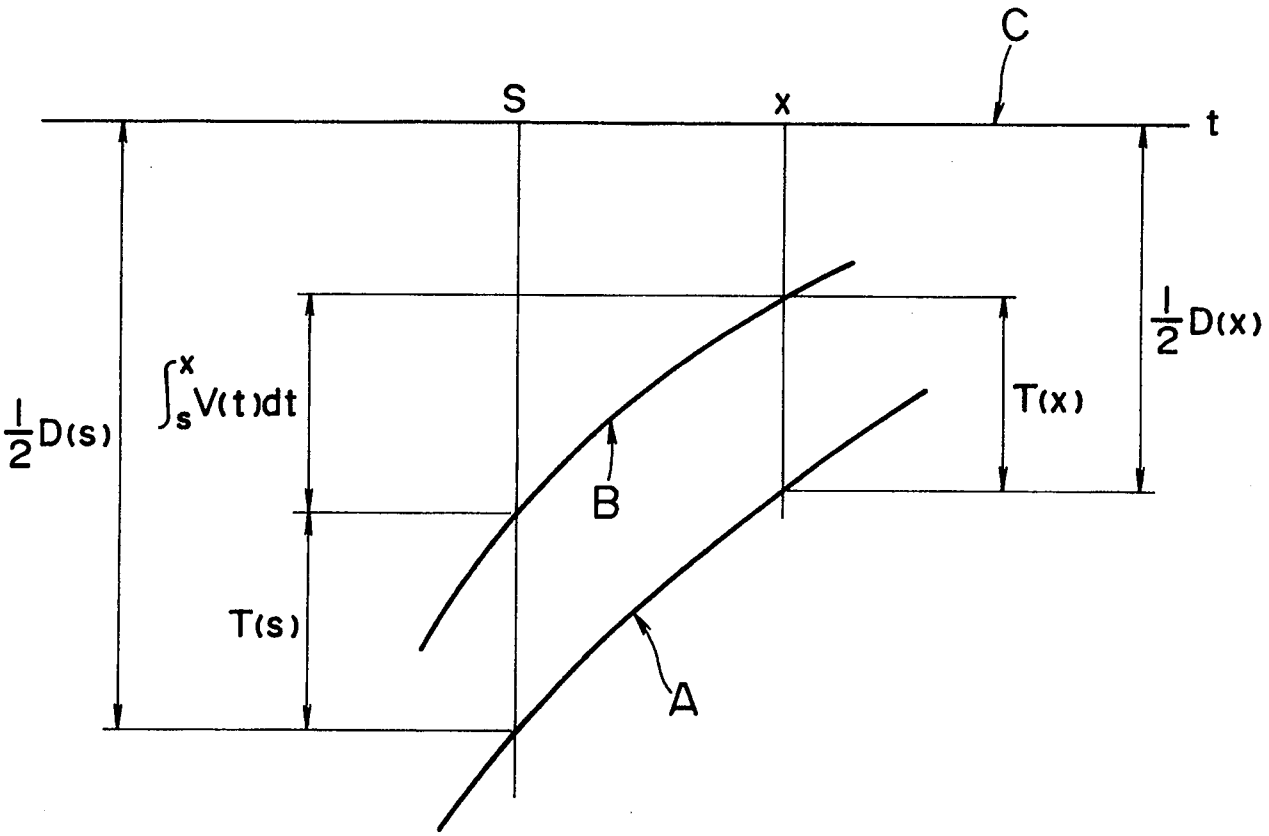
Figure 3:
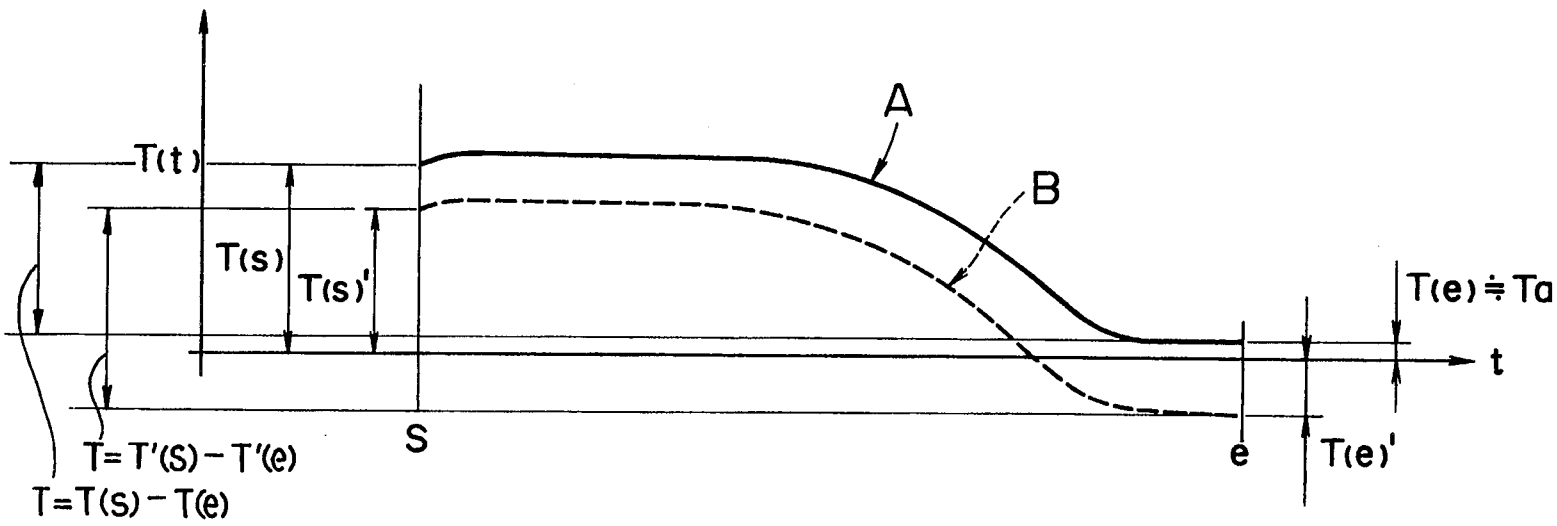

FIG. 1 is a block diagram of an apparatus used in performing the method in accordance with the present invention, FIG. 2 is a graph of a grinding wheel position and a graph of a workpiece surface as functions of time, to explain the determination of workpiece deformation, in accordance with the present invention, and FIG. 3 is a graph showing a change of deformation with time, to explain the determination of workpiece deformation in accordance with the present invention.

5. DETAILED DESCRIPTION OF THE PREFERRED EMBODIMENT

A grinding wheel 1 for an external cylindrical grinding machine is driven by an actuator (not shown). The grinding wheel can move back and forth, towards or away from a workpiece 2, which is supported at its ends. An automatic outer diameter measuring device 3 can move back and forth with respect to the workpiece 2 and automatically measures the outer diameter of workpiece 2 during the grinding. Probes 4 of the automatic outer diameter measuring device 3 contact the outer surface of the workpiece 2. A digital data signal 12 encoding the outer workpiece diameter generated by the automatic outer diameter measuring device 3 is sent to a deformation determining device 7 through an amplifier 5 and an A/D converter 6. To the deformation determining device are also transmitted a signal 13 representing the shift of grinding wheel 1 and a signal 14 representing the operation start position.

The shift of grinding wheel 1 may be detected by a position detector 8 using a linear gage or the like, or may be calculated from the position data of grinding wheel 1 stored in a grinding machine controller 9, or may be calculated by integrating with an integrator 10 the actually measured values of infeed velocity of grinding wheel 1 or the infeed data contained in the grinding machine controller 9.

The deformation of the workpiece 2 is obtained from the difference between the shift of grinding wheel 1 from a predetermined position and the decrease of the outer diameter of workpiece 2. This position of the grinding wheel is determined by an operation start position setting device 11.

The operation start position setting device 11 may be a device which generates a calculation start signal 14 according to a signal from a contact sensor 16, such as a shock sensor or an acoustic emission (AE) sensor for detecting the contact of grinding wheel 1 with workpiece 2. Alternatively, it may be a device which outputs a calculation start signal 14 when the workpiece 2 is ground to some extent according as determined by the signal 12 from the A/D converter. In the latter case, the operation start signal 14 is generated, when the difference in the outer diameter of workpiece 2 as measured at certain time intervals exceeds a predetermined value. Alternatively, the operation start signal 14 may be generated, when the difference between the outer diameter of workpiece 2 before grinding and the measured value of the diameter exceeds a predetermined value. At this time, the calculation for determining deformation may be performed only when the difference exceeds a predetermined value.

When the calculation start signal 14 is sent to the deformation determining device 7 from the calculation start position setting device 11, the calculation for determining the deformation 1 of workpiece 2 starts. An algorithm for determining the deformation by the device 7 will be described below with reference to FIGS. 2 and 3. Here, the case where the shift of grinding wheel 1 is determined by integrating the infeed velocity data 15 contained in the grinding machine controller 9 will be described.

In FIG. 2, line C represents the finally finished surface of workpiece 2. The abscissa is the coordinate of time. Curve A represents the actual ground surface, and curve B represents the position of grinding wheel 1. It is found from FIG. 2 that the deformation of workpiece 2 is expressed by Eq. (1).

$$T(x) = \int_s^x V(t)dt + (D(x) - D(s))/2 + T(s) \quad (1)$$

where,

V(t): infeed velocity of grinding wheel 1 at time t

D(t): outer diameter of grinding wheel 2 at time t

T(t): deformation at time t s: calculation start time x: a time point

In Eq. (1), the first term indicates the shift of grinding wheel, the second term indicates the change in diameter of workpiece, the sum of the first and second terms indicates the change in deformation, and the third term indicates the initial deformation.

If the onset of contact of grinding wheel 1 with the workpiece 2 can be correctly detected at the start time, the initial deformation T(s) equals zero, and there is no problem. However, when the beginning of contact is not detected correctly, or when a position where the workpiece 2 has been ground to some extent is set to the start point, the initial deformation T(s) does not equal zero.

In FIG. 3, the abscissa is the time coodinate and the ordinate is the deformation. Curve A represents the trace of deformation for a workpiece for the present time, and curve B represents that for the last time. The symbols in FIG. 3 denote the followings.

T'(s): deformation at start for the last time

T'(e): final deformation for the last time

Ta: deformation preset for the time at grinding completion e: Grinding completion time Assuming the diameter at the operation start time is D(s) and the diameter at the present time is represented by D(x), and the shift of the grinding wheel is represented by ΔA, the deformation T(x) at a time during the grinding is determined by the equation:

$$T(x) = \Delta A + T(s) + (D(s) - D(x)/2.$$

As indicated in FIG. 3, the deformation T(t) changes from the initial deformation T(s) to the final deformation T(e) at the grinding completion time. The difference T' (s)−T' (e), between the deformation T' (s) at beginning and the final deformation T' (e) is constant for the workpiece of the same material. Thus, the difference in the last time is nearly equal to the difference T(s)−T(e) between the deformation T(s) at the beginning and the final deformation T(e).

$$T(s) - T(e) = T'(s) - T'(e)$$

T(e) is nearly equal to Ta.

$$T(e) \approx Ta$$

Therefore, the following equation stands.

$$T(s) - Ta = T'(s) - T'(e)$$

Since the deformation T(s) at the beginning is usually inexact and inconstant as described above, it cannot be used. In grinding of workpieces 2 of the same material, the final deformation in the last time is added as the initial deformation for the next time.

Specifically, the deformation T(s) at the beginning is set to the value expressed by Eq. (2). As a result, the final deformation T(e) for the present time becomes the preset value of residual deformation Ta approximately, independently from selection of the start point.

$$T(s) = T'(s) - T'(e) + Ta \quad (2)$$

The grinding machine controller 9 can employ an optimal control on the basis of the deformation T(x) calculated by Eq. (1) using the deformation T(s) determined by the deformation determining device according to Eq. (2). In an optimal control, a control using fuzzy logic can also be employed.

According to the present invention, the approximate deformation can be determined by calculation independently from the start point, and an optimal control considering the effect of the deformation can be practically realized.

I claim:

1. In a method for determining a deformation of a workpiece on a grinding machine, said grinding machine have a grinding wheel for grinding a rotating workpiece, comprising the steps of:

measuring a diameter D(s) of a selected workpiece;

measuring a position A of the grinding wheel for working on said workpiece;

determining a start time s for calculating a deformation of said selected workpiece, said start time s being the time when the diameter of said workpiece is reduced more than a predetermined value in a predetermined time interval, an initial diameter D(s) being the diameter of said selected workpiece at said start time s;

setting an initial deformation T(s) of said selected workpiece at said start time s to be zero for a first workpiece, and in case of workpieces other than said first workpiece, setting the initial deformation T(s) to be a difference between the initial deformation of an immediately prior workpiece and a deformation obtained for that prior workpiece;

calculating a deformation change of said selected workpiece after said start time s, by subtracting a radius change (D(s)−D(t))/2 of said selected workpiece from a shift in position ΔA of said grinding wheel; and calculating deformation T(t) of said selected workpiece, by adding said initial deformation T(s) and said deformation change ΔA−(D(s)−D(t))/2:

$$T(t)=T(s)=\Delta A-(D(s)-D(t))/2.$$

2. A method according to claim 1, wherein a predetermined final deformation Ta is added in determining the deformation of said selected workpiece:

$$T(t)=T(s)+\Delta A-(D(s)-D(t))/2+Ta.$$

3. A method according to claim 1, further comprising the step of operating a position detector to directly detect the position of said grinding wheel, the shift ΔA of said grinding wheel being determined from the difference between a real time output A(t) of said position detector and an initial output value A(s):

$$\Delta A=A(s)-A(t).$$

4. A method according to claim 1, further comprising the step of integrating an infeed velocity V(t) of said grinding wheel at time t over a period from the calculation start time s to a time x, whereby the deformation T(x) is obtained by the expression:

$$T(x) = \int_s^x V(t)dt + (D(x) - D(s))/2 + T(s)$$

5. A method for determining a deformation of a workpiece on a grinding machine having a grinding wheel, comprising the steps of:

automatically measuring a diameter D(t) of the workpiece;

automatically measuring a position of the grinding wheel;

automatically and periodically computing, from the measured diameter of the workpiece, a reduction in the diameter of the workpiece;

automatically comparing the computer diameter reduction to a predetermined diameter reduction value;

upon exceeding of said predetermined diameter reduction value by the computed diameter reduction, setting an initial deformation value T(s) to be a difference between an initial deformation for an immediately prior workpiece and a final deformation for the prior workpiece, the initial deformation value for the first workpiece being set equal to zero; and upon exceeding of said predetermined diameter reduction value by the computed diameter reduction, automatically and periodically calculating (i) a shift ΔA in position of said grinding wheel, (ii) a change in radius (D(s)−D(e))/2 of said workpiece, where D(s) is the diameter at start time s and D(e) is the diameter at finish time e, (iii) a change in deformation of said workpiece as a difference between grinding wheel position change ΔA and workpiece radius change (D(s)−D(e))/2 and (iv) an instantaneous or real time deformation value T(t) of said workpiece by adding said initial deformation value T(s) and said change in deformation of said workpiece, ΔA−(D(s)−D(e))/2:

$$T(t)=T(s)+\Delta A-(D(s)-D(e))/2.$$

6. The method defined in claim 5 wherein said step of calculating includes the step of adding a predetermined final deformation Ta in determining the deformation T(t):

$$T(t)=T(s)+\Delta A-(D(s)-D(e))/2+Ta.$$

7. The method defined in claim 5 wherein said step of automatically measuring a position of said grinding wheel includes the step of operating a position detector to directly detect the instantaneous or real time position of said grinding wheel, the shift ΔA in position of said grinding wheel being determined as a difference between an output A(t) of said position detector and an initial position A(s) of said grinding wheel as determined by said position detector:

$$\Delta A=A(s)-A(t).$$

8. The device defined in claim 5 wherein step of automatically measuring a position of said grinding wheel includes the step of integrating an infeed velocity V(t) of said grinding wheel, said step of calculating a change in deformation of said workpiece including the step of adding the integrated infeed velocity to the workpiece diameter change (D(s)−D(t)/2, said step of calculating an instantaneous or real time deformation T(t) of said workpiece including the computation of:

$$T(t) = \int_s^t V(t)dt - (D(s) - D(t))/2 + T(s).$$

* * * * *